US009065201B2

(12) United States Patent
Borgfeld et al.

(10) Patent No.: US 9,065,201 B2
(45) Date of Patent: Jun. 23, 2015

(54) ELECTRICAL CONNECTOR MODULES FOR WELLBORE DEVICES AND RELATED ASSEMBLIES

(75) Inventors: Christine Borgfeld, Alvin, TX (US); John E. Fuller, Richmond, TX (US); Robert F. Morton, Sarasota, FL (US)

(73) Assignee: Schlumberger Technology Corporation, Sugar Land, TX (US)

( * ) Notice: Subject to any disclaimer, the term of this patent is extended or adjusted under 35 U.S.C. 154(b) by 636 days.

(21) Appl. No.: 13/331,596

(22) Filed: Dec. 20, 2011

(65) Prior Publication Data

US 2013/0153205 A1 Jun. 20, 2013

(51) Int. Cl.

| | |
|---|---|
| ***E21B 43/11*** | (2006.01) |
| ***H01R 13/58*** | (2006.01) |
| *E21B 17/02* | (2006.01) |
| *E21B 43/119* | (2006.01) |

(52) U.S. Cl.

CPC ..... *H01R 13/5833* (2013.01); *E21B 17/023* (2013.01); *E21B 43/11* (2013.01); *E21B 43/119* (2013.01)

(58) Field of Classification Search

CPC ..... E21B 29/02; E21B 17/028; E21B 17/023; E21B 43/11; E21B 43/119; H01R 13/5833

USPC ..... 166/55, 65.1, 242.1, 242.2

See application file for complete search history.

(56) References Cited

U.S. PATENT DOCUMENTS

| | | | | |
|---|---|---|---|---|
| 2,669,928 | A * | 2/1954 | Sweetman | 175/4.6 |
| 4,160,152 | A | 7/1979 | Wightman | |
| 4,423,918 | A | 1/1984 | Filreis et al. | |
| 4,767,349 | A | 8/1988 | Pottier et al. | |
| 4,973,262 | A | 11/1990 | Gerke | |
| 6,681,861 | B2 | 1/2004 | Davidson et al. | |
| 7,661,366 | B2 | 2/2010 | Fuller et al. | |
| 7,674,124 | B2 | 3/2010 | Nicholson | |
| 7,731,515 | B2 | 6/2010 | Nicholson | |
| 7,819,666 | B2 | 10/2010 | Sihler et al. | |
| 7,819,683 | B2 | 10/2010 | Nicholson | |
| 7,841,412 | B2 | 11/2010 | Jasser et al. | |
| 8,018,384 | B2 | 9/2011 | Floyd et al. | |
| 2006/0148304 | A1 | 7/2006 | Kennedy | |
| 2008/0196898 | A1 | 8/2008 | Jasser et al. | |
| 2008/0227322 | A1 | 9/2008 | Nicholson | |
| 2009/0015485 | A1 | 1/2009 | Floyd et al. | |
| 2009/0047815 | A1 | 2/2009 | Nicholson | |
| 2010/0115769 | A1 | 5/2010 | Nicholson | |
| 2010/0130027 | A1 | 5/2010 | Sihler et al. | |
| 2010/0139909 | A1 | 6/2010 | Tirado et al. | |
| 2011/0024116 | A1 | 2/2011 | McCann | |

FOREIGN PATENT DOCUMENTS

| | | | |
|---|---|---|---|
| EP | 0435721 | A1 | 7/1991 |
| WO | 2010061167 | A1 | 6/2010 |

* cited by examiner

*Primary Examiner* — Nicole Coy

(74) *Attorney, Agent, or Firm* — Jeffery Peterson; Brandon Clark

(57) ABSTRACT

An electrical connector module is for completing an electrical connection in a wellbore device. The module has an outer surface having at least one groove that receives and frictionally retains an electrical wire in a circuitous path that relieves strain on the wire. An electrical connector is at least partially disposed in the at least one groove and is connected to the electrical wire.

21 Claims, 9 Drawing Sheets

ELECTRICAL CONNECTOR MODULES FOR WELLBORE DEVICES AND RELATED ASSEMBLIES

BACKGROUND

In downhole applications, such as perforating, it is often necessary to cut wires to length to make electrical connections. Perforating guns in particular have numerous configurations where wire length varies for each application. Existing wiring connections in these applications often are made using splice-type connectors, which connect wires directly to other wires. Electronics and electrical components such as detonators and electrical switches include attached lead wires, which are used to make the splice connections. Wires are pulled out of the component, such as for example a firing head or connector module, spliced together, and then pushed or fed back into the component while being assembled with other components.

SUMMARY

This summary is provided to introduce a selection of concepts that are further described below in the detailed description. This summary is not intended to identify key or essential features of the claimed subject matter, nor is it intended to be used as an aide in limiting the scope of the claimed subject matter. Examples of electrical connector modules are provided herein for completing electrical connections in a wellbore device. In some examples, the electrical modules have an outer surface with a plurality of grooves that receive and frictionally retain an electrical wire in a circuitous path that relieves strain on the wire. In some examples, the circuitous path can be a serpentine path oriented normal to a longitudinal axis of the module. An electrical connector can be at least partially disposed in at least one groove in the plurality of grooves and can include at least one contact for displacing or cutting through insulation on the electrical wire. The contact can be electrically connected to a circuit and an initiation module. A plug connector can be in electrical contact with the contact for connecting to another device in the wellbore. In some examples, a tool is also provided to force the wire into at least one groove in the plurality of grooves to cause the blade to displace or cut insulation on the wire and thereby form the electrical connection. In some examples, the tool can include a manually operable lever. Modular perforating gun assemblies incorporating electrical connector modules are also disclosed.

BRIEF DESCRIPTION OF THE DRAWINGS

Embodiments of electrical connector modules for wellbore devices are described with reference to the following figures. The same numbers are used throughout the figures to reference like features and components.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. Various equivalents, alternatives and modifications are possible within the scope of the appended claims. The different devices described herein may be used alone or in combination with other devices. For example, electrical connector modules are described for wellbore devices in association with perforating technologies; however, the concepts of the present disclosure are applicable to a large variety of other wellbore devices and technologies outside of the perforation arts. The present disclosure is not intended to be limited for use with perforation devices or technologies but rather can be utilized with any other wellbore devices that require electrical connection amongst components.

As used herein, the terms "up" and "down"; "upper" and "lower"; "uppermost" and "lowermost"; "uphole" and "downhole"; "above" and "below" and other like terms indicating relative positions above or below a given point or element are used in this description to more clearly describe some embodiments of the disclosure. However, when applied to assemblies and methods for use in wells that are deviated or horizontal, such terms may refer to left to right, right to left, or other relationships as appropriate.

Figure 1:
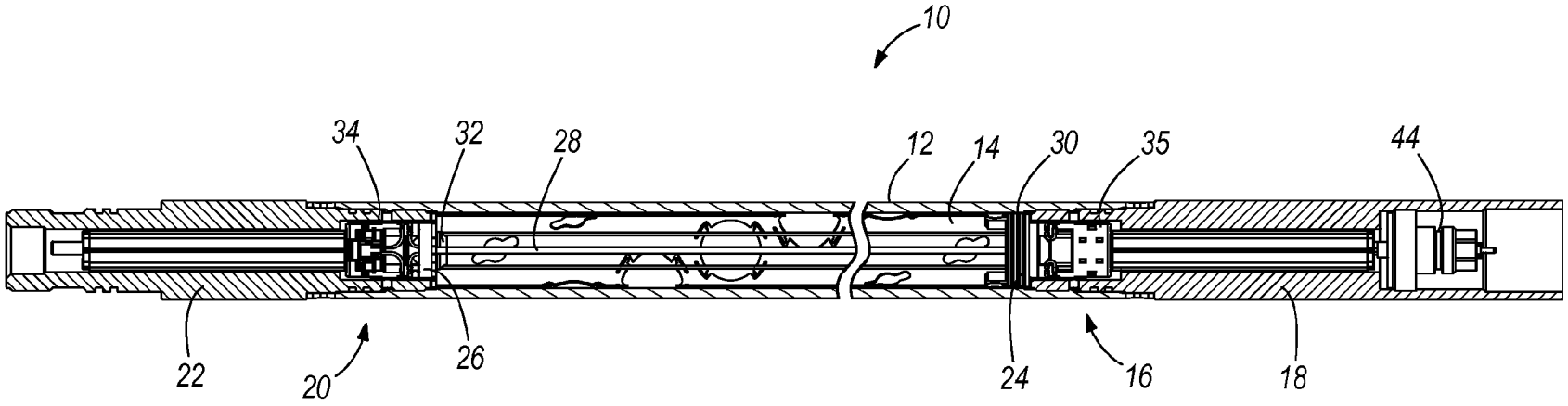
FIG. 1 is a section view of a wellbore device having an electrical connector module.

FIG. 1 depicts a perforating gun 10. The perforating gun 10 has a casing 12 and a loading tube 14, which is disposed in the casing 12 and supports a series of shaped charges (not shown). The length of the perforating gun 10 and the number, type, and orientation of the shaped charges can vary. A first end 16 of the perforating gun 10 is connected to a first gun adapter 18 for connecting the perforating gun 10 to other wellbore components (not shown). A second end 20 of the perforating gun 10 is connected to a second gun adapter 22 for connecting the perforating gun 10 to other wellbore components (not shown). In use, the perforating gun 10 and the first and second gun adapters 18, 22 are disposed in a wellbore such that the first gun adapter 18 is located downhole with respect to the second gun adapter 22; however the orientation of the perforating gun 10 in the wellbore can vary and other configurations and orientations of the respective perforating gun 10, first gun adapter 18 and second gun adapter 22 can be employed.

A detonating cord 28 extends through the perforating gun 10 and is configured to ignite the shaped charges for perforating the wellbore and surrounding subterranean formation in a conventional manner. The detonating cord 28 has a first end 30 that extends from the first end 16 of the perforating gun 10 and a second end 32 that extends from the second end 20 of the perforating gun 10. The first and second ends 30, 32 of the detonating cord 28 extend from the perforating gun 10 into respective electrical connector modules 35, 34, which are connected to the first and second ends 16, 20 of the perforating gun 10. In this example, the electrical connector modules 34, 35 are disposed in the respective first and second gun adapters 18, 22 and are connected to the perforating gun 10 via respective first and second loading tube adapters 24, 26; however other configurations may vary and it is not necessary that the modules 35, 34 be connected to the perforating gun 10 via the loading tube adapters 24, 26. In the example shown, one or both of the electrical connector modules 34, 35 contains conventional initiator circuitry (not shown) and explosive material for, upon an operator's command, initiating the detonating cord 28 from either or both ends 16, 20 of the perforating gun 10. For the purposes of discussion herein, the connector module 34 located at the second end 20 (i.e. the uphole end) of the perforating gun 10 is provided with the noted initiator circuitry and explosive material; however the same characteristics can be alternately or also be provided in the electrical connector module 35 located at the first end 16 (i.e. the downhole end) of the perforating gun 10. Therefore the discussion herein regarding connector module 34 equally applies to both connector modules 34, 35.

Figure 2:
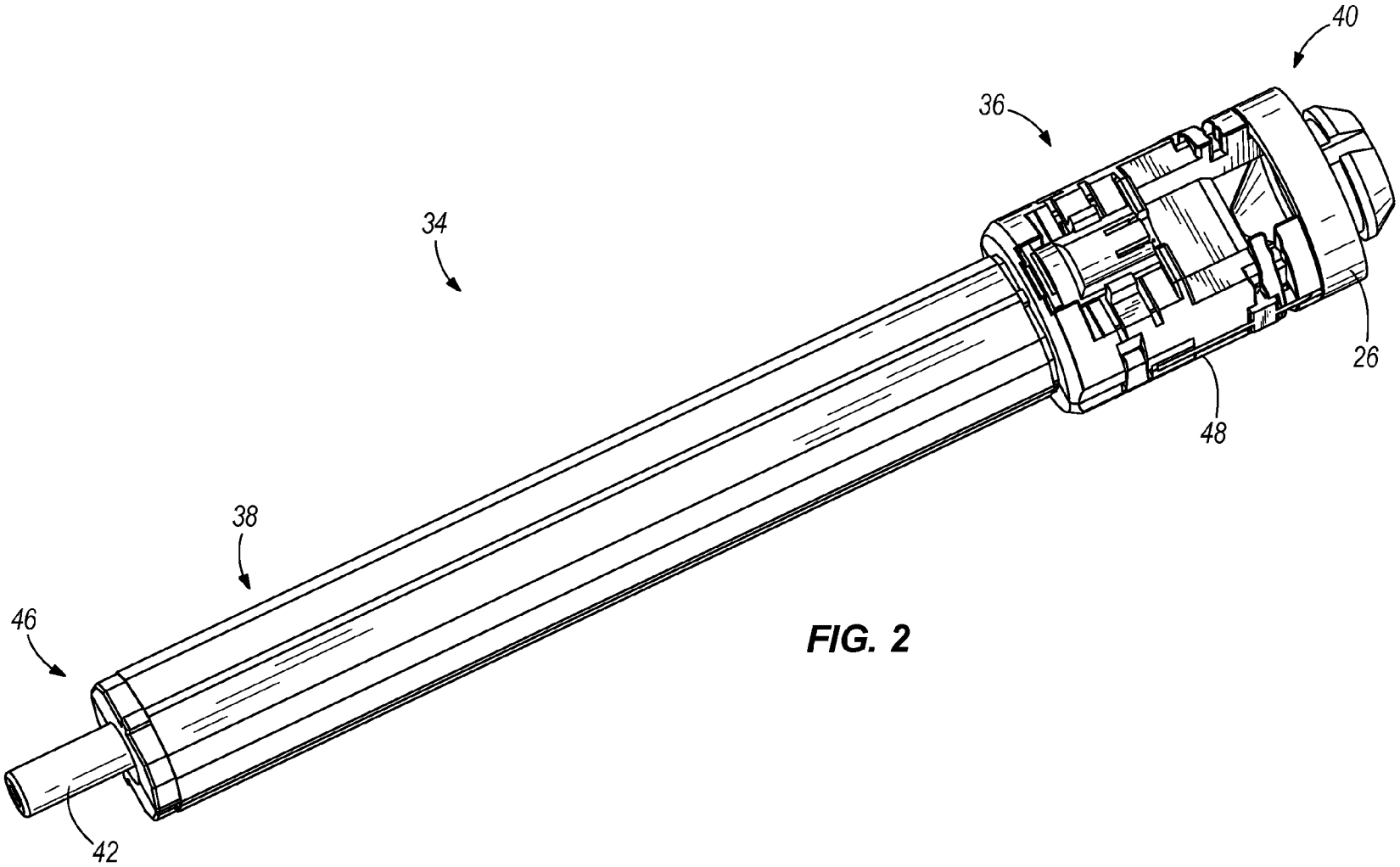
FIG. 2 is a perspective view of the module shown in FIG. 1.

FIG. 2 depicts the electrical connector module 34 in perspective. The module 34 includes an initiator housing 36 and an extension tube 38, which is optional. The initiator housing 36 contains the noted initiator circuitry and explosive material (not shown). A first end 40 of the connector module 34 is connected to the second end 20 of the perforating gun 10 via the loading tube adapter 26, and a second end 46 of the connector module 34 has a plug connector 42 for electrically connecting with another wellbore device, such as for example the pressure bulkhead and electrical feedthrough device 44 shown connected to the electrical connector module 35 in FIG. 1.

Figure 3:
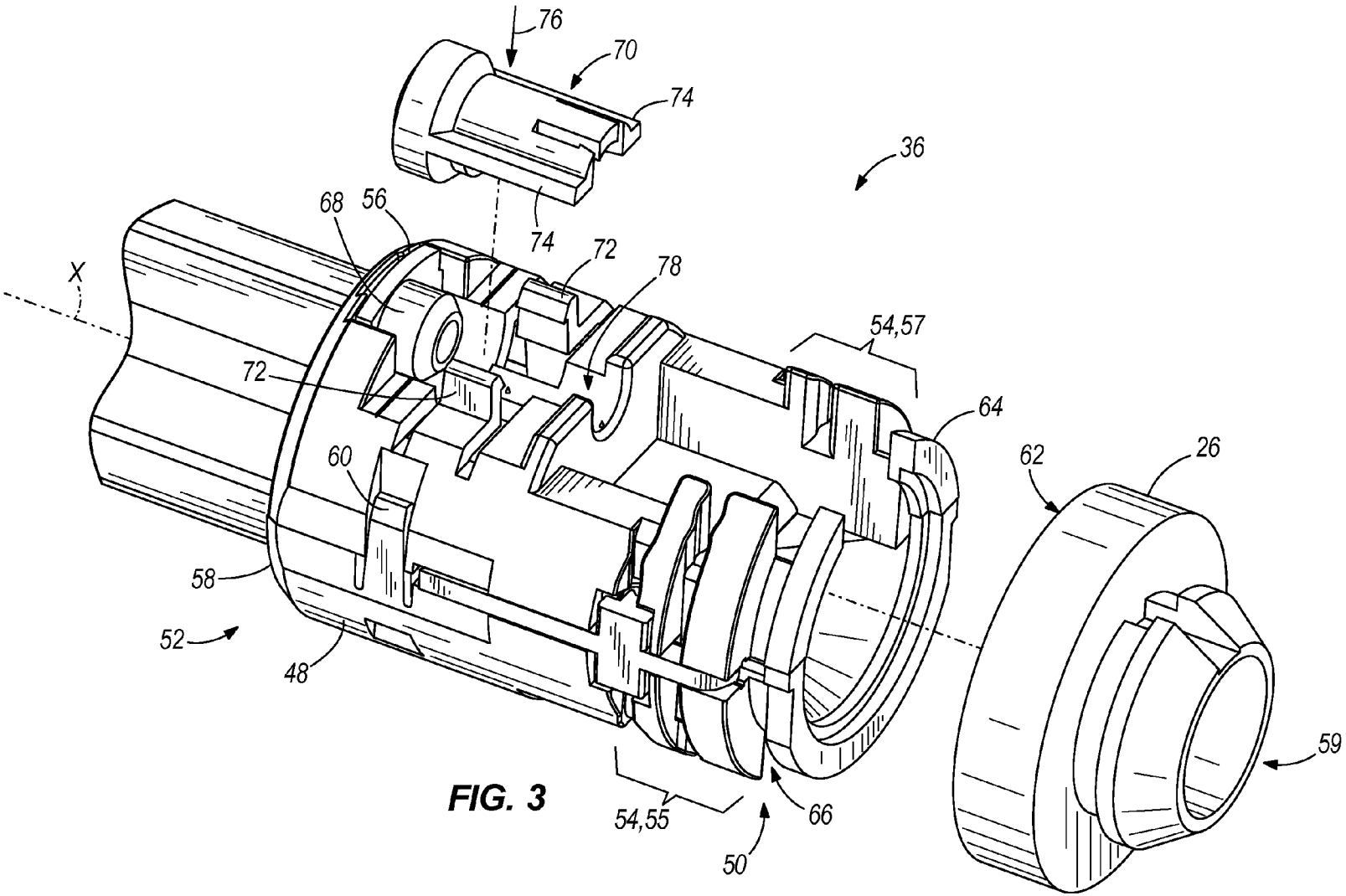
FIG. 3 is an exploded view of the module shown in FIG. 2.

Referring to FIG. 3, the initiator housing 36 is generally cylindrical-shaped and has a circumferential outer surface 48 that extends longitudinally between a first axial end 50 (also referred to herein as a "receiving end") and a second axial end 52. A plurality of grooves 54 are formed in the outer surface 48 proximate to the first axial end 50. The plurality of grooves 54 includes a first set of grooves 55 and a second set of grooves 57, each of which are located on diametrically opposite sides of the outer surface 48. Each set of grooves 55, 57 follows a circuitous path, which in this example includes a serpentine path that winds back and forth along the respective side of the outer surface 48. More specifically, each of the first and second sets of grooves 55, 57 is oriented normal to a longitudinal axis X along which initiator housing 36 extends and traverses back and forth along about 180 degrees of the circumferential outer surface 48. The exact orientation, length, and configuration of the plurality of grooves 54 can vary from that shown. In other examples, the serpentine path can be oriented at an transverse angle other than normal to the longitudinal axis X, or can be oriented parallel to the longitudinal axis X. In other examples, the circuitous path does not include a serpentine path. In this and other examples, the circuitous path weaves radially at least into and/or out of the outer surface 48 of the initiator housing 36. In other examples, the circuitous path does not weave into or out of the outer surface 48. In other examples, the plurality of grooves 54 includes one or more than two grooves for connecting to one or more than two electrical wires. The plurality of grooves 54 can have different configurations and can have one or more circuitous paths that effectively receive and securely retain electrical wires extending from the perforating gun 10, as will be explained herein below. In still other embodiments, the outer surface 48 has means for receiving and frictionally retaining a wire in a circuitous path, wherein the means comprises a plurality of grooves 54 or one more projections on the outer surface 48.

The initiator housing 36 has an upper housing portion 56 and lower housing portion 58, which are joined together by releasable latches 60 disposed on each side of the initiator housing 36 and also by connection of the loading tube adapter 26 on the first axial end 50 of the initiator housing 36. In other examples, the initiator housing 36 can be made of one piece or more than two pieces. The latches 60 are resilient fingers that extend from the lower housing portion 58 and grasp the upper housing portion 56. Other equivalent releasable latch configurations could be employed in addition to or instead of that which is shown. The loading tube adapter 26 can be formed from a resilient material such as rubber and/or the like and has a resilient receiving end 62 for receiving and engaging with a flange 64 that defines a groove 66 around the outer surface 48 of the initiator housing 36 proximate the first axial end 50. In this example, during assembly of the initiator housing 36, the flange 64 is inserted into the receiving end 62 of the loading tube adapter 26 such that the loading tube adapter 26 engages with the flange 64 and retains the upper and lower housing portions 56, 58 together in the orientation shown in the figures. The resiliency of the receiving end 62 allows for expansion thereof to receive the flange 64 and subsequent contraction thereof to engage with the flange 64. The loading tube adapter 26 has a central opening 59 extending axially therethrough, through which the detonating cord 28 and electrical wires associated with operation of the perforating gun 10 can extend. The electrical wires and attachment thereof to the initiator housing 36 will be described further herein below. As stated above, numerous alternate configurations for the loading tube adapter 26 can be employed, one example of which is shown as element 24 in FIGS. 1 and 7, and will be further described herein below.

The initiator housing 36 contains a conventional explosive element 68 for initiating the detonating cord 28. A retaining clip 70 is also provided for retaining the detonating cord 28, which is not shown in FIG. 3, with the upper housing portion 56 of the initiator housing 36. The retaining clip 70 is retained on the upper housing portion 56 by a pair of latches 72. Latches 72 engage with outer edges 74 of the retaining clip 70 when the retaining clip 70 is inserted in the direction of arrow 76 onto the upper housing portion 56. Although not shown in FIG. 3, the detonating cord 28 thus extends through the central opening 59 and resides in a channel 78 formed in the upper housing portion 56 and is retained in place by the retaining clip 70 when the clip 70 is latched with latches 72.

Figure 4:
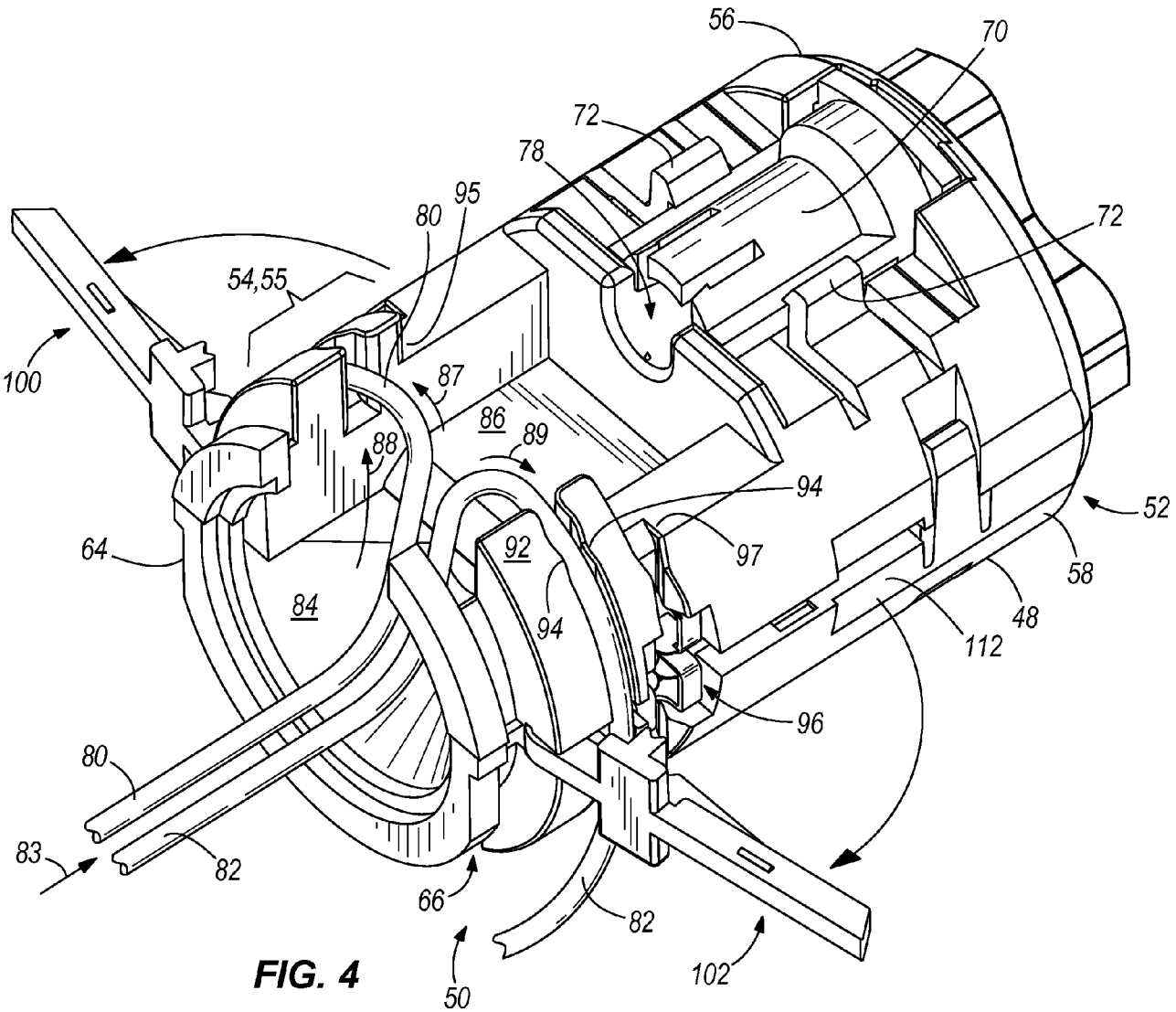
FIG. 4 is a partial view of the module and electrical wires connected to the module.
Figure 5:
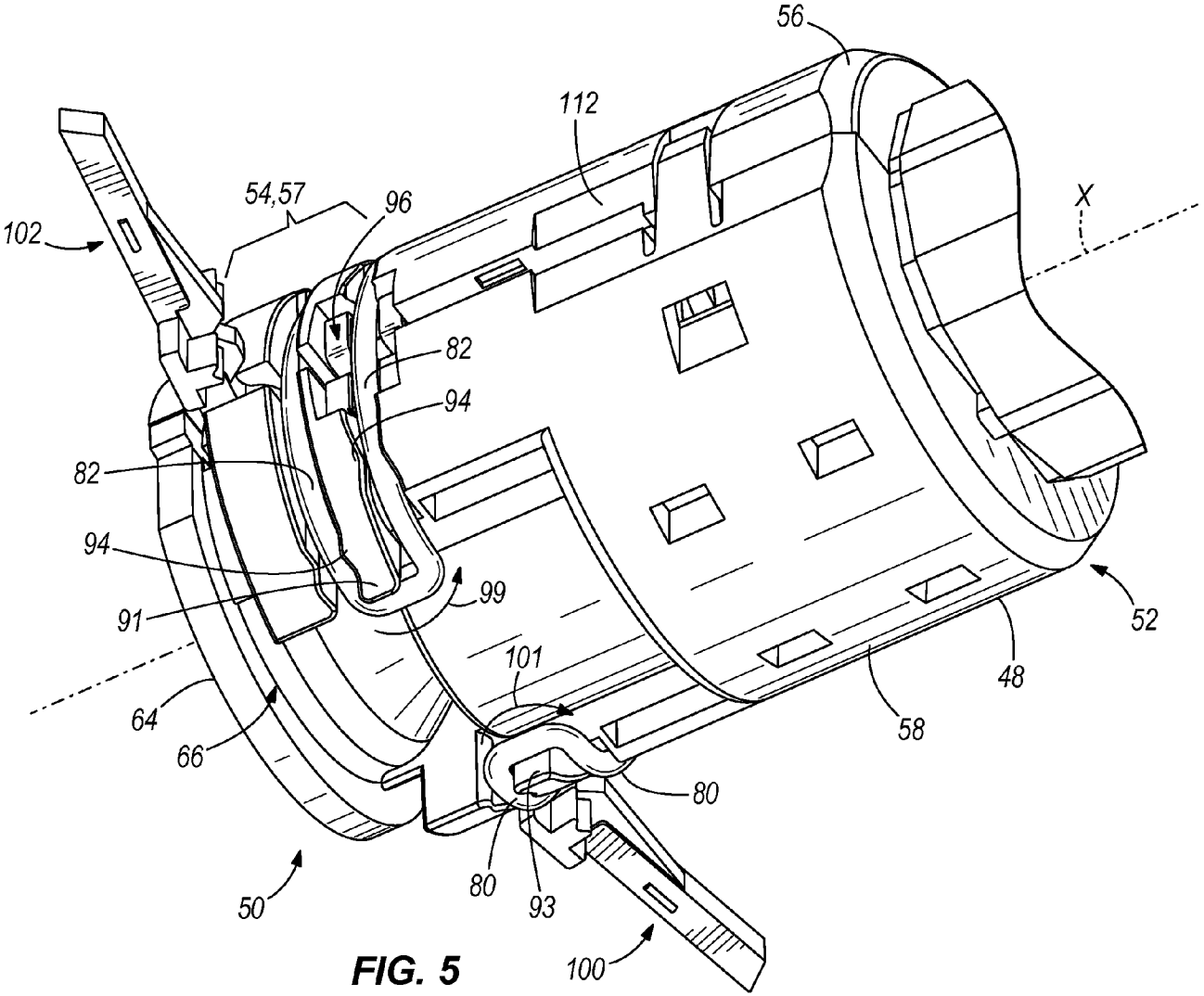
FIG. 5 is view of the example in FIG. 4, from another perspective.
Figure 6:
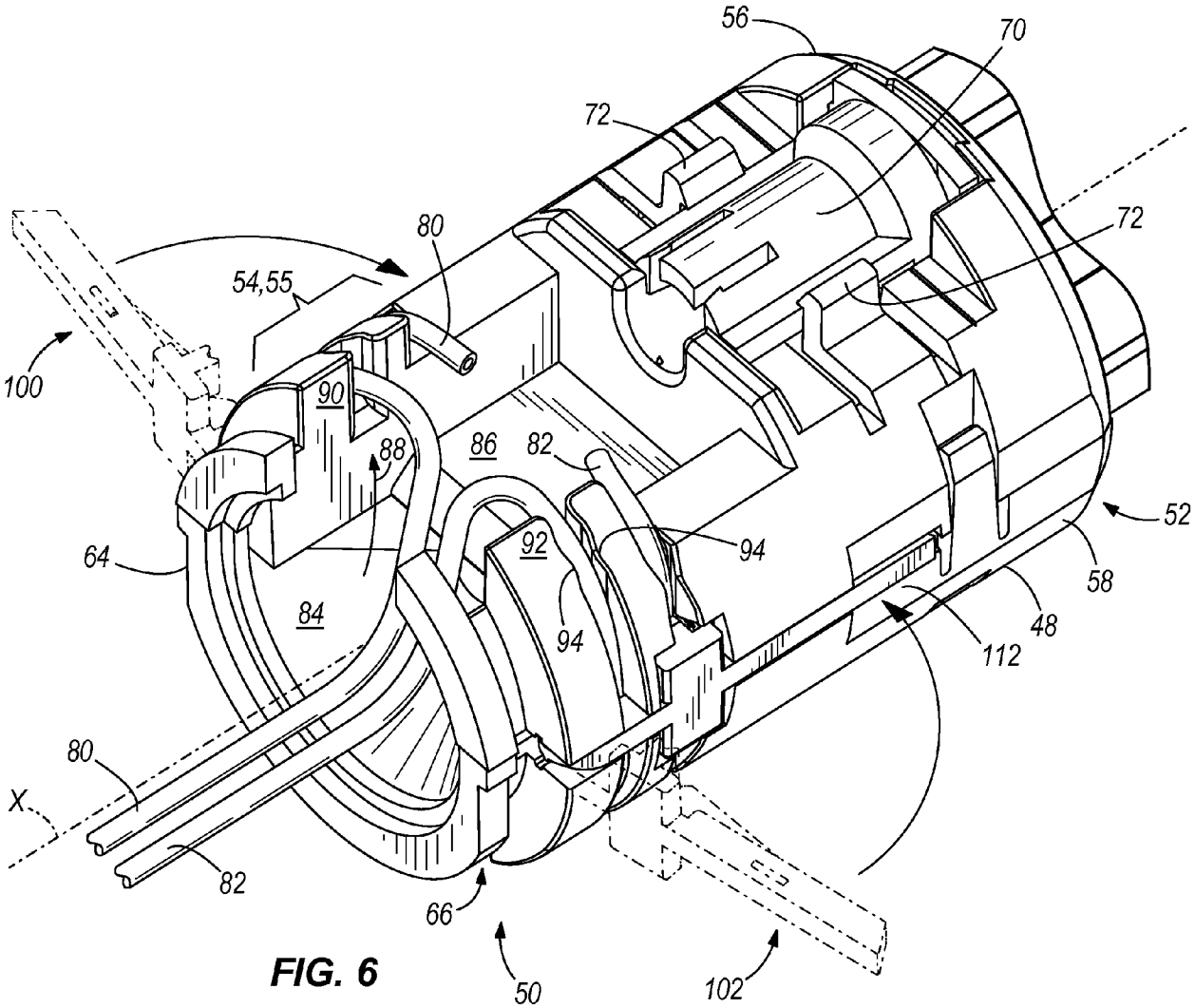
FIG. 6 is shows the electrical wires connected to the module.

Referring now to FIGS. 4-7, the electrical connector module 34 is configured to complete an electrical connection in a wellbore device, which in this example is the perforating gun 10. More specifically, the connector module 34 is configured to receive and frictionally retain a pair of perforating gun electrical wires 80, 82 in a circuitous path formed at least in part by the plurality of grooves 54 so as to relieve strain on electrical wires 80, 82 and protect the electrical wires 80, 82 from damage. In this example, the first (receiving) axial end 50 of the initiator housing 36 receives the electrical wires 80, 82. Specifically, the free ends of the electrical wires 80, 82 can be manually inserted into the receiving end 50 in the direction of arrow 83. Although not shown in FIG. 4, the electrical wires 80, 82 will typically extend through and out of the central opening 59 of the loading tube adapter 26. The receiving end 50 has a sloped surface 84 that guides the wires 80, 82 radially outwardly through a radial opening 86 in the module 34 when the wires 80, 82 are axially fed into the receiving end 50 and against the sloped surface 84 in the direction of arrow 83. Arrow 88 shows the direction in which the wires 80, 82 are forced radially out of the receiving end 50 and radially out of the upper housing portion 56 of the initiator housing 36. Once the free ends of the electrical wires 80, 82 extend out of the opening 86, the wires 80, 82 are manually separated and wrapped in diametrically opposite directions, shown by arrows 87, 89 around the circumferential outer surface 48 of the initiator housing 36. One wire 80 is wrapped around a bend 90 formed at the first set of grooves 55 and the other wire 82 is wrapped around a bend 92 that is formed at the second set of grooves 57. Thereafter, as shown in FIG. 5, each wire 80, 82 is wrapped back towards the opening 86 at a respective bend 91, 93 located on the lower housing portion 58, as shown by arrows 99, 101. Each wire 80, 82 is wrapped along the circumferential outer surface 48 toward the opening 86. As shown in FIG. 6, the free ends of the wires 80, 82 extend axially out of the plurality of grooves 54. Although not shown, in some examples, the retaining clip can be long enough to cover and protect the free ends of the wires 80, 82 from damage.

In the example shown, the plurality of grooves 54 has several indentations 94 for frictionally engaging the electrical wires 80, 82. The indentations 94 can extend inwardly into a groove from only one side of a groove, or alternately from both sides of a groove. The indentations 94 slightly narrow the width of the grooves 54 so as to enact an interference fit with the insulation on the electrical wires 80, 82. Indentations 94 are optional features that can enhance the retaining effect of the plurality of grooves 54.

Figure 7:
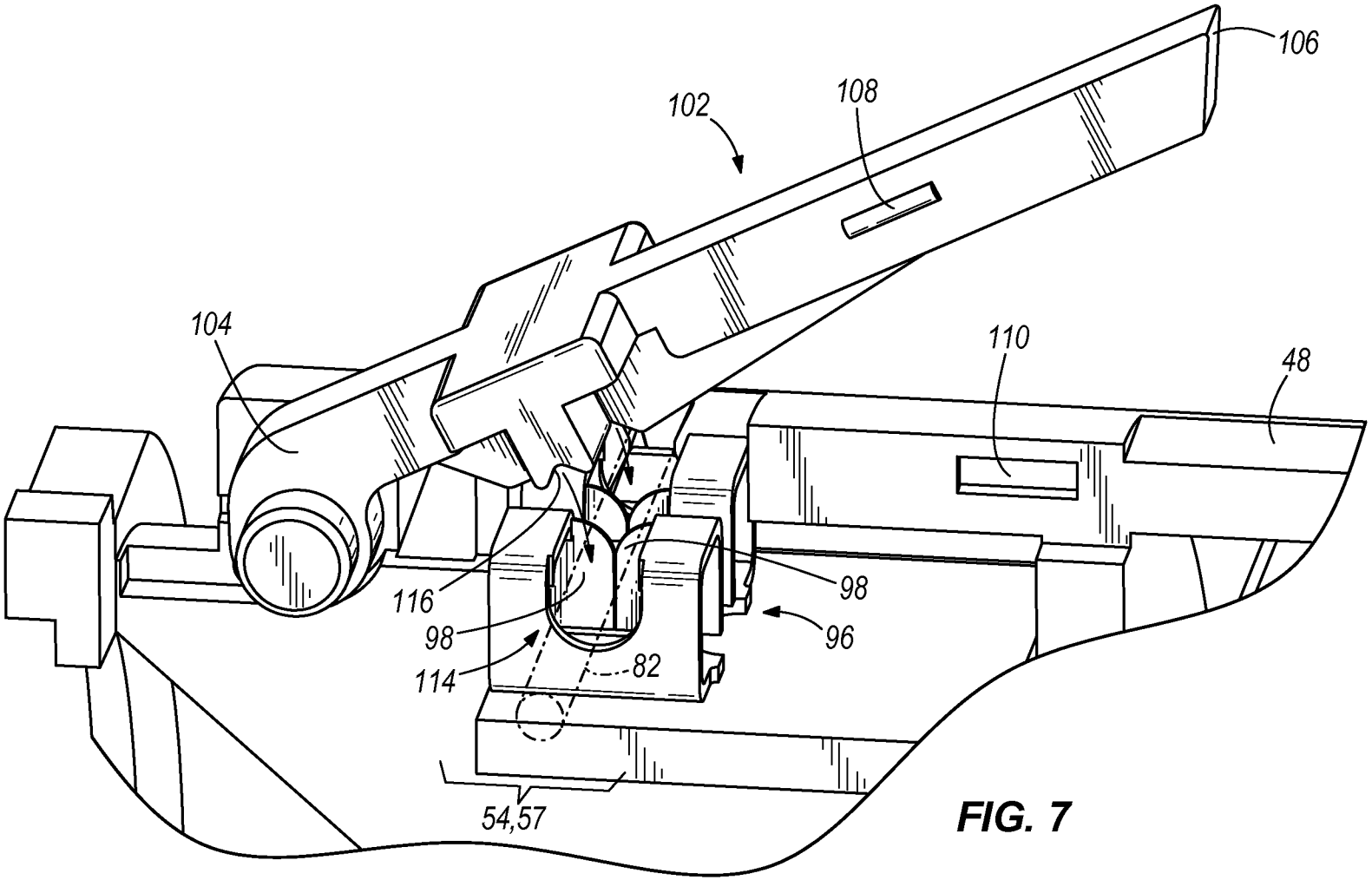
FIG. 7 shows a tool for forcing the wire into a plurality of grooves on the module.

As shown in FIGS. 4, 5 and 7, an electrical connector 96 is disposed in each of the first and second sets of grooves 55, 57 of the plurality of grooves 54 and is configured to connect with the electrical wires 80, 82. The electrical connector 96 can be electrically connected to the noted initiator circuitry and/or to the plug connector 42 for connecting to another device in the wellbore, as discussed above, to effectively electrically connect the perforating gun 10 with the initiator circuitry and with other devices located in the wellbore or on the surface of the well. The type and configuration of the electrical connector 96 can vary. In this example, the electrical connector 96 includes a pair of contacts, which in this example are blades 98 that are configured to cut through the insulation on electrical wires 80, 82 and make electrical contact with the wires 80, 82 when the wires 80, 82 are inserted into the plurality of grooves 54. The blades 98 of the electrical connector 96 are thus electrically connected to the wires 80, 82 for performing detonation activities. Other types of electrical connectors 96 can be utilized, for example spikes, pins, needles, and/or the like.

As shown in FIGS. 4-7, tools 100, 102 are provided to force the wires 80, 82 into the plurality of grooves 54 and thereby force the blades 98 to displace or cut the insulation on the wires 80, 82 and form the electrical connection therebetween. The type of tool 100, 102 can vary. In this example, tools 100, 102 are manually operable levers having a pivot end 104 and a handle end 106. Each tool 100, 102 is movable from the position shown in FIGS. 4 and 5 to the position shown in FIG. 6 to clamp down on the wires 80, 82 and thereby force the wires 80, 82 into the plurality of grooves 54 and against the blades 98 to displace or cut the insulation on the wires 80, 82 and thereby form the noted electrical connection. The handle end 106 of the tools 100, 102 is provided with a tab 108 for engaging with a recess 110 in a snap-fit engagement so as to retain the tools 100, 102 in position against the initiator housing 36, as shown in FIG. 6, when the electrical connection is made. An indentation 112 is provided in the outer surface 48 of the initiator housing 36 to allow an operator's finger to manually grasp the handle end 106 of the tools 100, 102 for moving the tools 100, 102 from the position shown in FIG. 6 to the position shown in FIGS. 4 and 5. The tool 100, 102 is thus configured to be inserted into a notch 114 in the plurality of grooves 54 in the initiator housing 36 so that an engagement surface 116 engages with the outer insulated surface of the wires 80, 82 and thereby forces the wires 80, 82 into engagement with the blades 98 as shown by the arrows in FIG. 7. The engagement surface 116 can be shaped to cooperate with the curved outer surface of the insulated wires 80, 82. In other embodiments, for example, the tools 100, 102 can embody a sliding lever having a cam surface for forcing the wires 80, 82 into connection with connector 96. Other like embodiments can be employed. The number of tools can also vary from that shown and one or more tools can be provided for each electrical wire, depending upon the particular connectivity required in a particular application.

Figure 8:
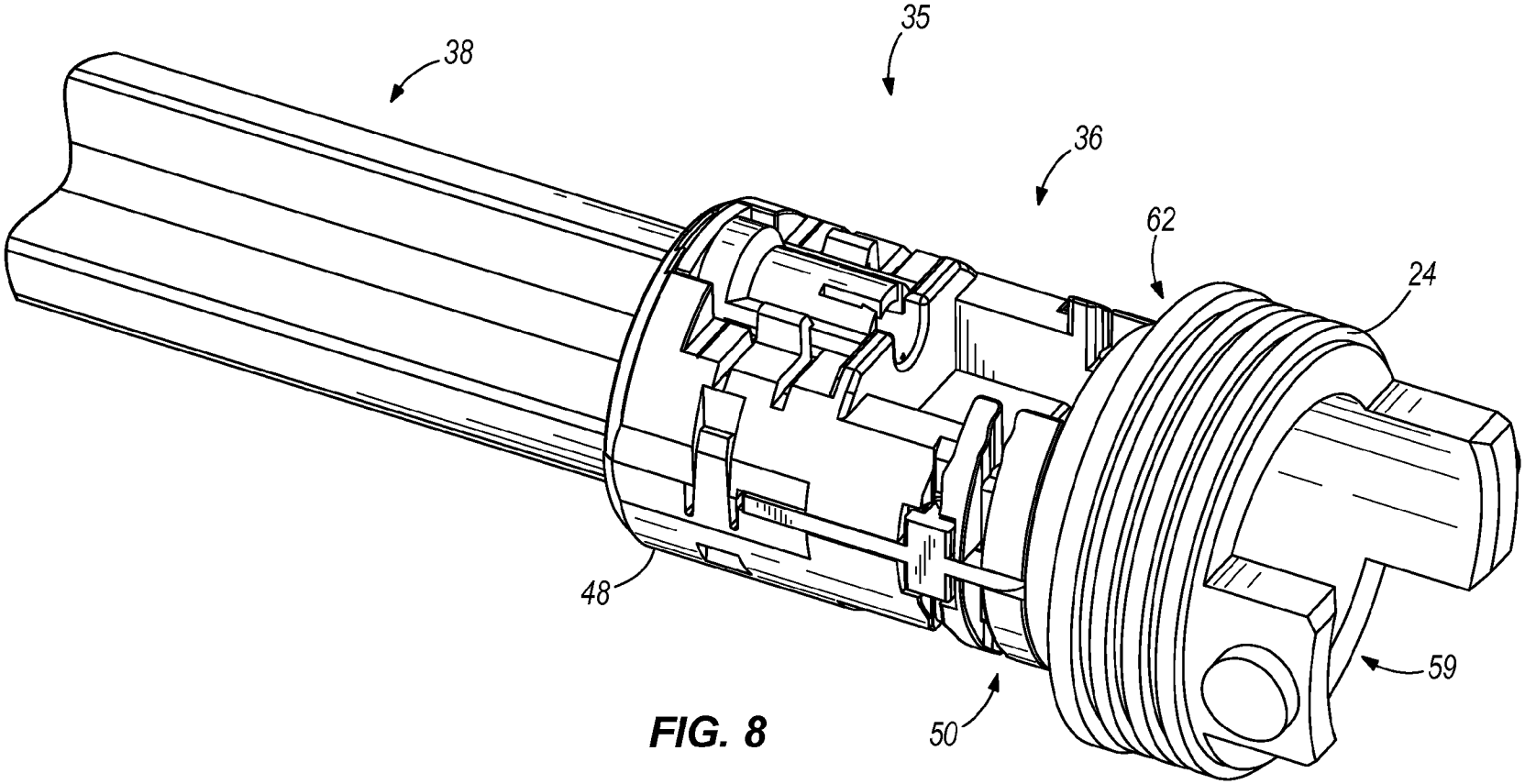
FIG. 8 is a perspective view of another example of an electrical connector module.

FIG. 8 depicts another example of a connector module 35 having the loading tube adapter 24. Similar to the loading tube adapter 26, the loading tube adapter 24 has a receiving end 62 for engaging with the first axial end 50 of the initiator housing 36. The loading tube adapter 24 has a different configuration for engaging with a different type of loading tube 14 on the perforating gun 10. As stated above, the particular configuration of the loading tube adapter, whether it be the configuration 24 or 26, is not material. Alternate configurations for loading tube adapters could be employed.

Figure 9:
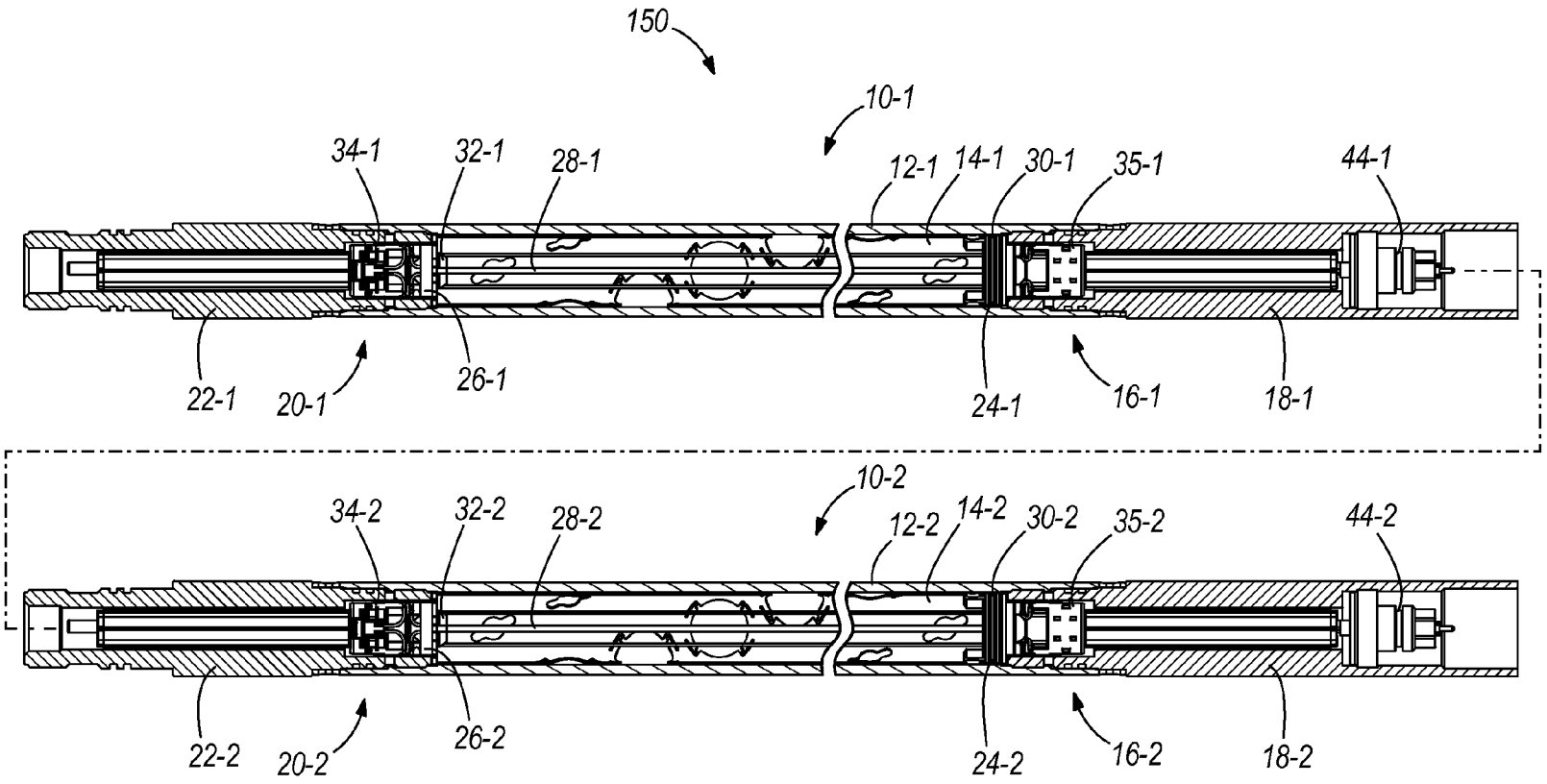
FIG. 9 is a section view of an assembly of perforating guns having electrical connector modules.

FIG. 9 depicts an assembly 150 having a modular connection between a first perforating gun 10-1 and a second perforating gun 10-2. The first perforating gun 10-1 has a first end 16-1 and a second end 20-1. The second perforating gun 10-2 has a first end 16-2 and a second end 20-2. An electrical connector module 35-1 electrically connects the first end 16-1 of the first perforating gun 10-1 to the second end 20-2 of the second perforating gun 10-2. As described in the example shown herein above in FIGS. 2-7, the electrical connector module 35-1 has a first end 40 having a housing 36 that receives and electrically connects with the electrical wires 80, 82 extending from the first end 16-1 of the perforating gun 10-1 while relieving strain on the electrical wires 80, 82 in the manner discussed above. The second end 46 of the electrical connector module 35-1 has a plug connector 42 for electrically connecting with the second end 20-2 of the second perforating gun 10-2. As in the example discussed above, the electrical connector module 35-1 includes the extension tube 38 extending from the housing 36 towards the second end 46 of the electrical connector module 35-1. This is optional. It can thus be seen that the electrical connector module 35-1 facilitates a modular connection between two or more perforating guns 10-1, 10-2, etc. The examples shown do not require a wire-to-wire connection between the respective perforating guns 10-1, 10-2, thus increasing durability and facilitating easier assembly. The combination of the electrical connector module 35-1 with two or more perforating guns thus advantageously allows conversion of a conventional perforating gun assembly into a modular assembly wherein each perforating gun plugs into the next perforating gun without wire connections therebetween.

It will thus be seen that the present disclosure provides an electrical connector module for completing electrical connections in wellbore devices. In some examples, the module includes an outer surface having a plurality of grooves that receive and frictionally retain an electrical wire in a circuitous path that relieves strain on the wire when one of the module and the device is moved with respect to the other of the module and device. The circuitous path can comprise a serpentine path that is oriented normal to a longitudinal axis of the module. The circuitous path can include a plurality of bends as well as indentations for frictionally engaging the electrical wire in the groove. An electrical connector can be at least partially disposed in at least one of the grooves and connected to the electrical wire. The electrical connector can include at least one blade that cuts through the insulation on the electrical wire and the plurality of grooves can be configured to retain the electrical wire such that when one of the module and the device is moved with respect to the other of the module and the device, the blade does not cut through the electrical wire.

A tool can also be provided that is movable to force the wire into the plurality of grooves to cause the blade to cut insulation on the wire and thereby form the electrical connection. In examples provided herein, the tool includes a manually operable lever having a pivot end and a handle end, which engages the electrical module in an interference fit. The module includes a receiving end for receiving the electrical wire and the plurality of grooves can be disposed between the receiving end and the tool, as shown in the drawing figures.

Further, it will thus be seen that the present disclosure provides modular perforating gun assemblies having at least first and second perforating guns and an electrical connector module electrically connecting the first end of the first perforating gun to the second end of the second perforating gun. The electrical connector module receives and electrically connects at least one electrical wire extending from the first perforating gun while relieving strain on the wire and has a plug connector for electrically connecting with the second perforating gun.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. An electrical connector module for completing an electrical connection in a wellbore device, the module comprising an outer surface having at least one groove that receives and frictionally retains an electrical wire in a circuitous path that relieves strain on the wire, wherein the at least one groove comprises a first set of grooves and a second set of grooves, and further comprising a first wire disposed in the first set of grooves and a second wire disposed in the second set of grooves.

2. A module according to claim 1, wherein the circuitous path comprises a serpentine path.

3. A module according to claim 2, wherein the serpentine path is oriented normal to a longitudinal axis of the module.

4. A module according to claim 2, wherein the circuitous path comprises a plurality of bends.

5. A module according to claim 1, wherein the at least one groove comprises at least one indentation for frictionally engaging the electrical wire in the plurality of grooves.

6. A module according to claim 1, comprising a receiving end for receiving the electrical wire, the receiving end comprising a sloped surface that guides the wire radially outwardly through an opening in the module when the wire is axially fed into the receiving end.

7. An electrical connector module for completing an electrical connection in a wellbore device, the module comprising an outer surface having at least one groove that receives and frictionally retains an electrical wire in a circuitous path that relieves strain on the wire, comprising an electrical connector connected to the electrical wire, wherein the electrical connector is at least partially disposed in the at least one groove.

8. A module according to claim 7, comprising a plug connector that is electrically connected with the electrical connector for connecting to another device in the wellbore.

9. A module according to claim 7, wherein the electrical connector comprises at least one contact that displaces insulation on the electrical wire.

10. An electrical connector according to claim 9, wherein at least one groove retains the electrical wire such that under strain, the contact does not damage the electrical wire.

11. A module according to claim 9, wherein the contact is electrically connected to a circuit for an initiation device.

12. A module according to claim 9, comprising a tool that is movable to force the wire into at least one groove to cause the contact to displace insulation on the wire and thereby form an electrical connection.

13. A module according to claim 12, wherein the tool comprises a manually operable lever having a pivot end and a handle end.

14. A module according to claim 13, wherein the lever engages with the electrical module in an interference fit.

15. A module according to claim 13, wherein the outer surface comprises an indentation for manually grasping the handle end of the lever.

16. A module according to claim 12, wherein the at least one groove comprises a notch, wherein the tool comprises a lever, and wherein the lever and the contact are at least partially disposed in the notch.

17. A module according to claim 11, wherein the module comprises a receiving end for receiving the electrical wire, wherein the at least one groove is disposed between the receiving end and the tool.

18. An electrical connector module for completing an electrical connection in a wellbore device, the module comprising an outer surface having at least one groove that receives and frictionally retains an electrical wire in a circuitous path that relieves strain on the wire when one of the module and device is moved with respect to the other of the module and device, an electrical connector at least partially disposed in the at least one groove and connected to the electrical wire, wherein when one of the module and the device is moved with respect to the other of the module and device, the at least one groove provides strain relief on the electrical wire and prevents disconnection between the electrical wire and electrical connector.

19. A modular perforating gun assembly, comprising:

a first perforating gun having a first end and a second end;

a second perforating gun having a first end and a second end;

an electrical connector module electrically connecting the first end of the first perforating gun to the second end of the second perforating gun, the electrical connector module comprising a first end that receives and electrically connects with at least one electrical wire extending from the first end of the first perforating gun while relieving strain on the at least one electrical wire and a second end having a plug connector for electrically connecting with the second end of the second perforating gun, wherein the first end has a housing comprising an outer surface having at least one groove that receives and frictionally retains the at least one electrical wire in a circuitous path that relieves strain on the wire; and an electrical connector comprising at least one contact that displaces insulation on the at least one electrical wire.

20. A modular perforating gun assembly according to claim 19, wherein the electrical connector module comprises an extension tube extending from the housing towards the second end of the electrical connector module.

21. A modular perforating gun assembly according to claim 19, wherein the electrical connector is at least partially disposed in the at least one groove and comprising a tool that is movable to force the at least one wire into the at least one groove to cause the contact to displace insulation on the wire and thereby form an electrical connection.

* * * * *